US010847903B2

(12) United States Patent
Huang et al.

(10) Patent No.: US 10,847,903 B2
(45) Date of Patent: Nov. 24, 2020

(54) ANTENNA SYSTEM AND ANTENNA STRUCTURE THEREOF

(71) Applicant: WISTRON NEWEB CORPORATION, Hsinchu (TW)

(72) Inventors: Tsun-Che Huang, Hsinchu (TW); Chih-Hsiang Liu, Hsinchu (TW)

(73) Assignee: WISTRON NEWEB CORPORATION, Hsinchu (TW)

( * ) Notice: Subject to any disclaimer, the term of this patent is extended or adjusted under 35 U.S.C. 154(b) by 27 days.

(21) Appl. No.: 16/516,462

(22) Filed: Jul. 19, 2019

(65) Prior Publication Data

US 2020/0091621 A1 Mar. 19, 2020

(30) Foreign Application Priority Data

Sep. 19, 2018 (TW) ..... 107133013 A

(51) Int. Cl.

| | |
|---|---|
| ***H01Q 25/00*** | (2006.01) |
| ***H01Q 1/02*** | (2006.01) |
| ***H01Q 1/24*** | (2006.01) |
| ***H01Q 5/307*** | (2015.01) |

(52) U.S. Cl.
CPC ..... *H01Q 25/001* (2013.01); *H01Q 1/02* (2013.01); *H01Q 1/246* (2013.01); *H01Q 5/307* (2015.01)

(58) Field of Classification Search
None
See application file for complete search history.

(56) References Cited

U.S. PATENT DOCUMENTS 5,068,671 A * 11/1991 Wicks ..... H01Q 21/26 343/799
6,559,810 B2 5/2003 McCorkle
2015/0380826 A1 12/2015 Yang et al.

* cited by examiner

*Primary Examiner* — Jany Richardson
(74) *Attorney, Agent, or Firm* — McClure, Qualey & Rodack, LLP

(57) ABSTRACT

An antenna structure includes a holder and a first antenna assembly. The holder includes a first board, a second board, a third board, and a fourth board. The first board, the second board, the third board, and the fourth board are connected to each other to surround a surrounding space. The first antenna assembly includes a first antenna body and a second antenna body. The first antenna body and the second antenna body are disposed in the surrounding space. The first antenna body and the second antenna body respectively include a feeding portion, a conjoining portion, and a ground portion. The ground portion of the first antenna body is connected to the first board. The ground portion of the second antenna body is connected to the second board.

15 Claims, 16 Drawing Sheets

ANTENNA SYSTEM AND ANTENNA STRUCTURE THEREOF

CROSS-REFERENCE TO RELATED PATENT APPLICATION

This application claims the benefit of priority to Taiwan Patent Application No. 107133013, filed on Sep. 19, 2018. The entire content of the above identified application is incorporated herein by reference.

Some references, which may include patents, patent applications and various publications, may be cited and discussed in the description of this disclosure. The citation and/or discussion of such references is provided merely to clarify the description of the present disclosure and is not an admission that any such reference is "prior art" to the disclosure described herein. All references cited and discussed in this specification are incorporated herein by reference in their entireties and to the same extent as if each reference was individually incorporated by reference.

FIELD OF THE DISCLOSURE

The present disclosure relates to an antenna system and an antenna structure, and more particularly to an antenna system and an antenna structure that support multiple frequencies and have two polarization directions.

BACKGROUND OF THE DISCLOSURE

In order to meet the high throughput and low latency requirements of 5th Generation Mobile Networks (5G), the use of high frequency millimeter wave bands is inevitable. In view of this, the 5G communication protocol has reserved multiple frequency bands for deploying micro-base stations or customer-provided equipment (CPE) with high capacity and high throughput. The antenna of the future micro base station or user terminal equipment must support more than two frequency bands at the same time, and must be able to radiate separately in two different polarization directions to meet the requirements of the fifth generation mobile communication system for polarization diversity.

In the related art, in order to solve the above-mentioned problem, an antenna array having dual frequency and dual polarization is often developed with a panel antenna. However, due to the loss of medium, the radiation efficiency of the panel antenna in the millimeter wave band is generally poor, falling at about 50% to 60%. In addition, since the bandwidth of the panel antenna is relatively narrow, it cannot satisfy the requirement of covering a plurality of frequency bands. Furthermore, the circuit board of the panel antenna also has a problem of poor heat dissipation efficiency. Therefore, in the related art, the antenna array formed by using the panel antenna will cause poor performance of the antenna array due to the above-mentioned problems.

SUMMARY OF THE DISCLOSURE

In response to the above-referenced technical inadequacies, the present disclosure provides an antenna system and an antenna structure.

In one aspect, the present disclosure provides an antenna system including: a chip and an antenna structure. The chip includes a first positive signal terminal, a second positive signal terminal, and at least one ground terminal. The antenna structure includes a holder and a first antenna assembly. The holder includes a first board, a second board, a third board, and a fourth board. The second board is connected to the first board. The third board is connected to the second board. The fourth board is connected between the third board and the first board. The first board, the second board, the third board, and the fourth board surround a surrounding space. A first slot is formed between the first board and the second board, a second slot is formed between the second board and the third board, a third slot is formed between the third board and the fourth board, and a fourth slot is formed between the fourth board and the first board. The first antenna assembly includes a first antenna body and a second antenna body. The first antenna body is disposed in the surrounding space. The second antenna body is disposed in the surrounding space. The first antenna body and the second antenna body respectively include a feeding portion, a conjoining portion connected to the feeding portion, and a ground portion connected to the conjoining portion. The ground portion of the first antenna body is connected to the first board, and the ground portion of the second antenna body is connected to the second board. The feeding portion of the first antenna body is coupled to the first positive signal terminal, and the feeding portion of the second antenna body is coupled to the second positive signal terminal. The first board is coupled to the ground terminal, and the second board is coupled to the ground terminal.

In another aspect, the present disclosure provides an antenna structure including: a holder, a first antenna assembly, and a second antenna assembly. The holder includes a first board, a second board, a third board, and a fourth board. The second board is connected to the first board. The third board is connected to the second board. The fourth board is connected between the third board and the first board. The first board, the second board, the third board, and the fourth board surround a surrounding space. A first slot is formed between the first board and the second board, a second slot is formed between the second board and the third board, a third slot is formed between the third board and the fourth board, and a fourth slot is formed between the fourth board and the first board. The first antenna assembly includes a first antenna body disposed in the surrounding space and a second antenna body disposed in the surrounding space The second antenna assembly includes a third antenna body disposed in the surrounding space and a fourth antenna body disposed in the surrounding space. The first antenna body, the second antenna body, the third antenna body, and the fourth antenna body respectively include a feeding portion, a conjoining portion connected to the feeding portion, and a ground portion connected to the conjoining portion. The ground portion of the first antenna body is connected to the first board, the ground portion of the second antenna body is connected to the second board, the ground portion of the third antenna body is connected to the third board, and the ground portion of the fourth antenna body is connected to the fourth board.

In yet another aspect, the present disclosure provides an antenna structure including: a holder and a first antenna assembly. The holder includes a first board, a second board, a third board, and a fourth board. The second board is connected to the first board. The third board is connected to the second board. The fourth board is connected between the third board and the first board. The first board, the second board, the third board, and the fourth board surround a surrounding space. A first slot is formed between the first board and the second board, a second slot is formed between the second board and the third board, a third slot is formed between the third board and the fourth board, and a fourth slot is formed between the fourth board and the first board. The first antenna assembly includes a first antenna body and a second antenna body. The first antenna body is disposed in the surrounding space. The second antenna body is disposed in the surrounding space. The first antenna body and the second antenna body respectively include a feeding portion, a conjoining portion connected to the feeding portion, and a ground portion connected to the conjoining portion. The ground portion of the first antenna body is connected to the first board, and the ground portion of the second antenna body is connected to the second board.

Therefore, one of the beneficial effects of the present disclosure is that the antenna system and the antenna structure provided by the embodiments of the present disclosure have the technical features of "the first board, the second board, the third board, and the fourth board surrounding a surrounding space," "a first slot being formed between the first board and the second board, a second slot being formed between the second board and the third board, a third slot being formed between the third board and the fourth board, and a fourth slot being formed between the fourth board and the first board," "a first antenna body being disposed in the surrounding space," and "a second antenna body being disposed in the surrounding space," so as to improve the radiation efficiency and the heat dissipation efficiency.

These and other aspects of the present disclosure will become apparent from the following description of the embodiment taken in conjunction with the following drawings and their captions, although variations and modifications therein may be affected without departing from the spirit and scope of the novel concepts of the disclosure.

BRIEF DESCRIPTION OF THE DRAWINGS

The present disclosure will become more fully understood from the following detailed description and accompanying drawings.

DETAILED DESCRIPTION OF THE EXEMPLARY EMBODIMENTS

Figure 1:
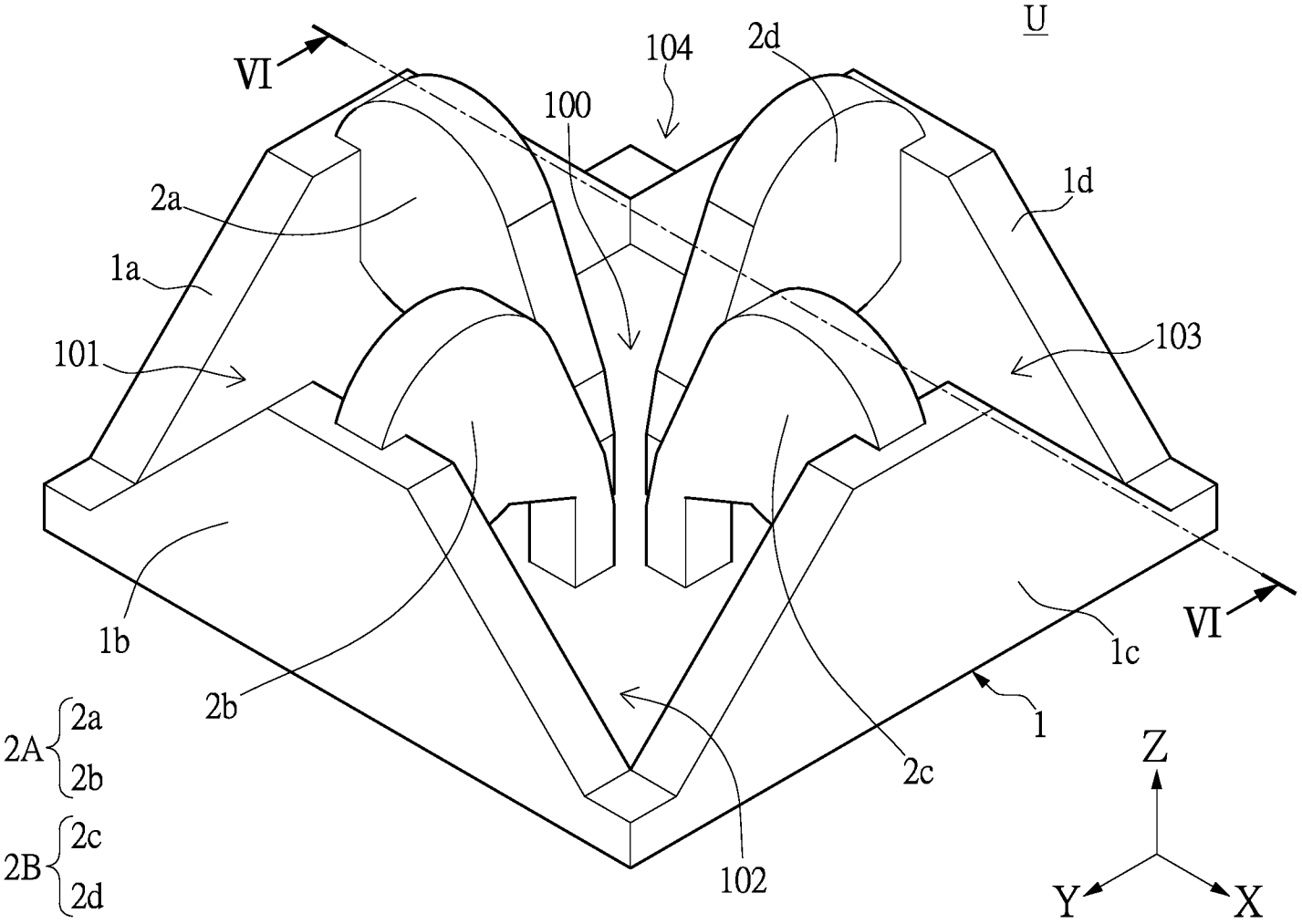
FIG. 1 is a schematic perspective assembled view of an antenna structure according to a first embodiment of the present disclosure.
Figure 2:
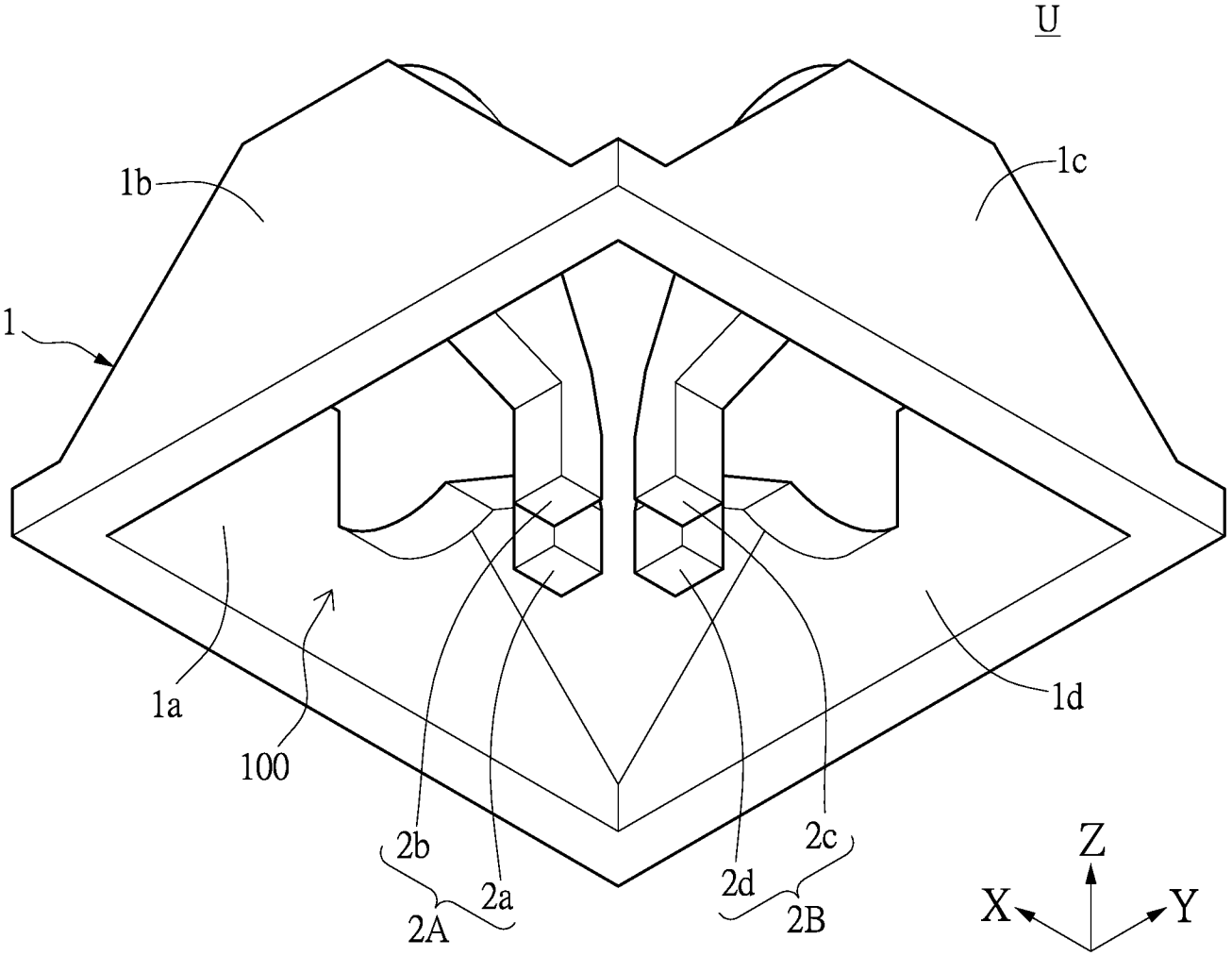
FIG. 2 is another schematic perspective assembled view of the antenna structure according to the first embodiment of the present disclosure.

The present disclosure is more particularly described in the following examples that are intended as illustrative only since numerous modifications and variations therein will be apparent to those skilled in the art. Like numbers in the drawings indicate like components throughout the views. As used in the description herein and throughout the claims that follow, unless the context clearly dictates otherwise, the meaning of "a", "an", and "the" includes plural reference, and the meaning of "in" includes "in" and "on". Titles or subtitles can be used herein for the convenience of a reader, which shall have no influence on the scope of the present disclosure.

The terms used herein generally have their ordinary meanings in the art. In the case of conflict, the present document, including any definitions given herein, will prevail. The same thing can be expressed in more than one way. Alternative language and synonyms can be used for any term(s) discussed herein, and no special significance is to be placed upon whether a term is elaborated or discussed herein. A recital of one or more synonyms does not exclude the use of other synonyms. The use of examples anywhere in this specification including examples of any terms is illustrative only, and in no way limits the scope and meaning of the present disclosure or of any exemplified term. Likewise, the present disclosure is not limited to various embodiments given herein. Numbering terms such as "first", "second" or "third" can be used to describe various components, signals or the like, which are for distinguishing one component/signal from another one only, and are not intended to, nor should be construed to impose any substantive limitations on the components, signals or the like.

First Embodiment

Figure 3:
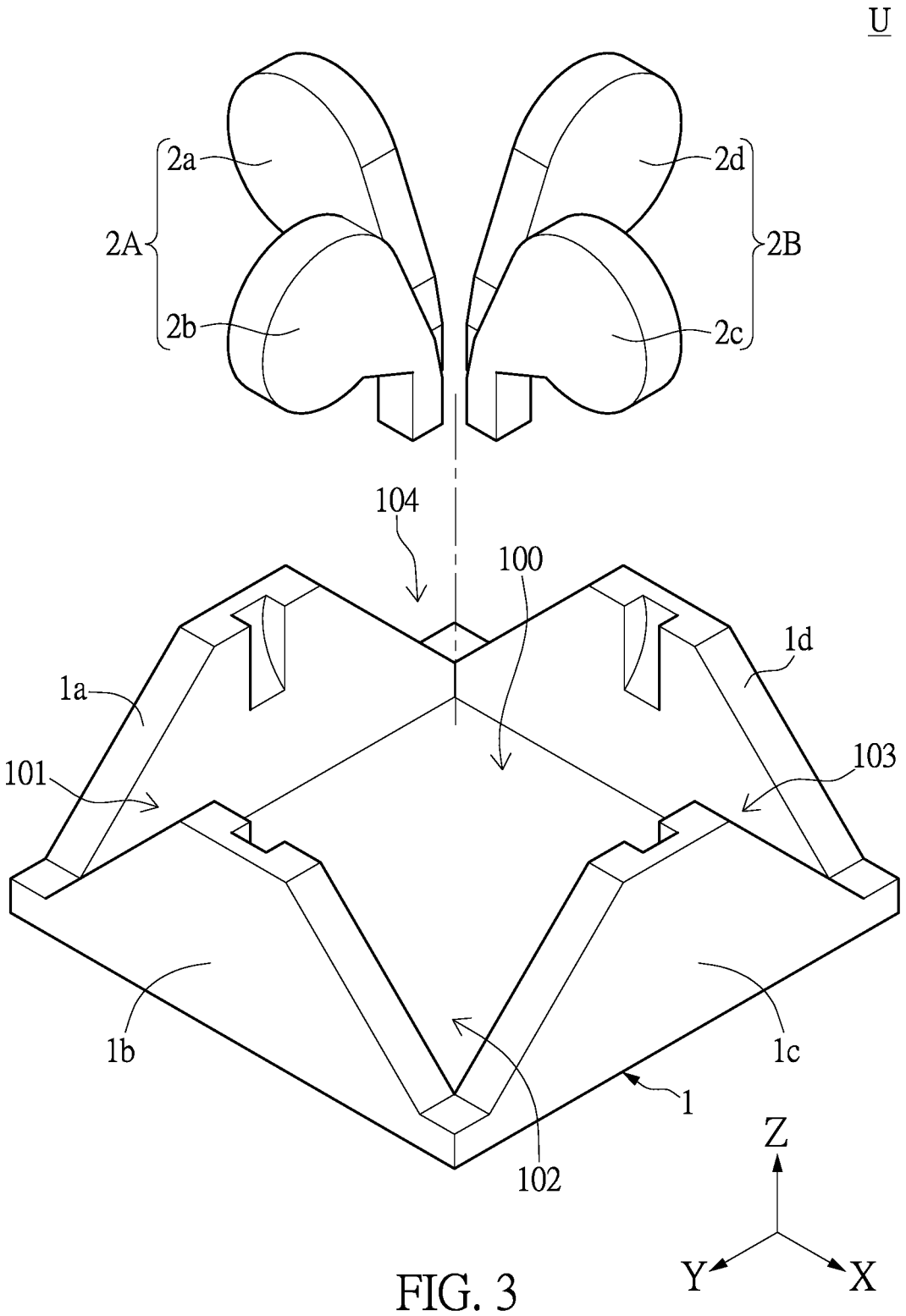
FIG. 3 is a schematic perspective exploded view of the antenna structure according to the first embodiment of the present disclosure.
Figure 4:
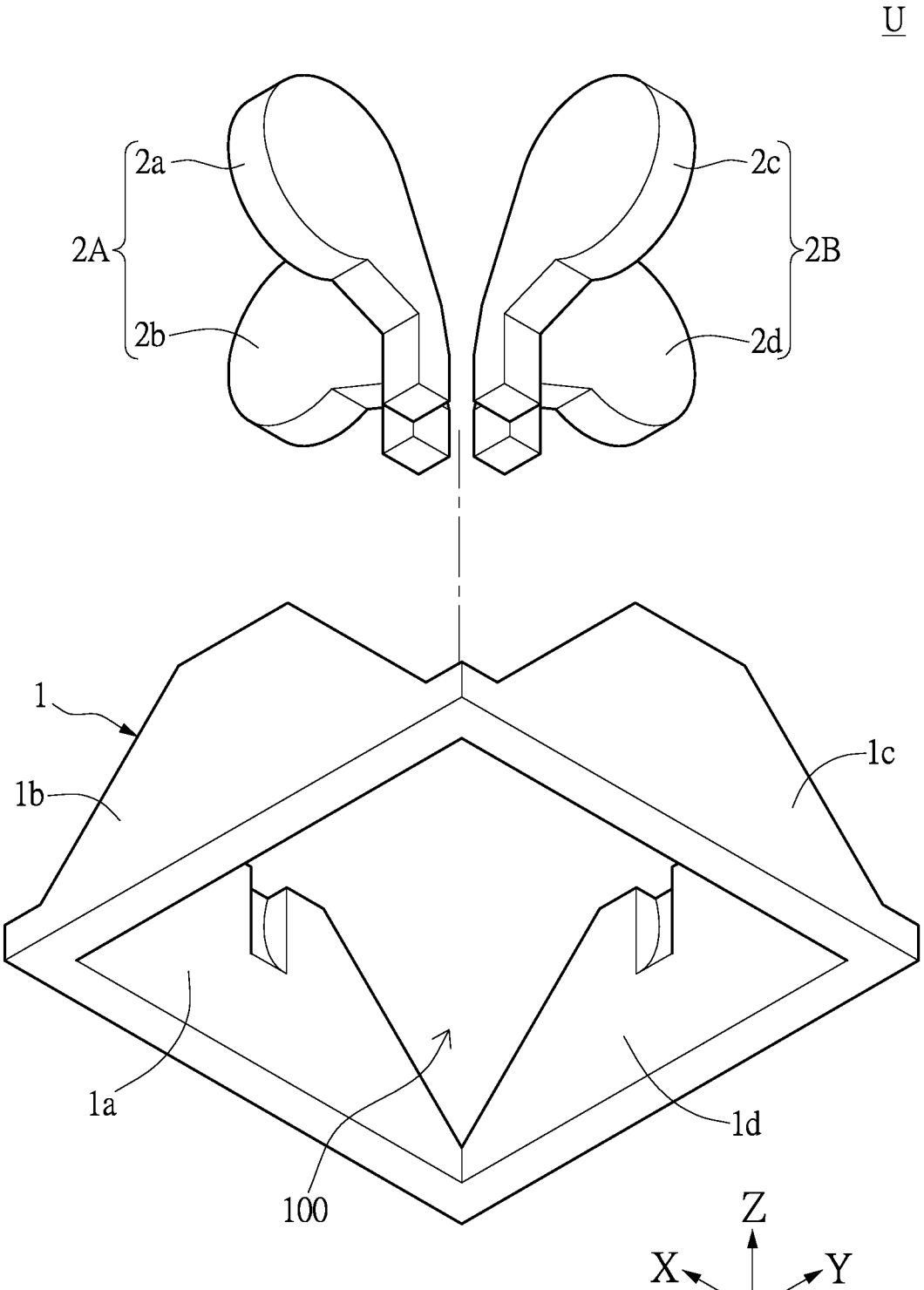
FIG. 4 is another schematic perspective exploded view of the antenna structure according to the first embodiment of the present disclosure.

Referring to FIG. 1 to FIG. 4, FIG. 1 and FIG. 2 are respectively schematic perspective assembled views of an antenna structure according to a first embodiment of the present disclosure, and FIG. 3 and FIG. 4 are respectively schematic perspective exploded views of the antenna structure according to the first embodiment of the present disclosure. The first embodiment of the present disclosure provides an antenna structure U including a holder 1, a first antenna assembly 2A, and a second antenna assembly 2B. The holder 1 may include a first board 1*a*, a second board 1*b*, a third board 1*c*, and a fourth board 1*d*. The first board 1*a*, the second board 1*b*, the third board 1*c*, and the fourth board 1*d* may be sequentially connected to each other to surround a surrounding space 100. Further, the first antenna assembly 2A may include a first antenna body 2*a* and a second antenna body 2*b*. The second antenna assembly 2B may include a third antenna body 2*c* and a fourth antenna body 2*d*. The first antenna body 2*a*, the second antenna body 2*b*, the third antenna body 2*c*, and the fourth antenna body 2*d* may be disposed in the surrounding space 100. For example, the antenna structure U provided by the present embodiment of the present disclosure can provide at least one operating frequency band, and the operating frequency band can range from 22 GHz to 40 GHz to be applied to the fifth generation mobile communication system. In addition, for example, the antenna structure U provided by the embodiment of the present disclosure may have at least a first operating frequency band with a frequency range between 26 GHz and 30 GHz and a second operating band with a frequency range between 36 GHz and 40 GHz, but the present disclosure is not limited thereto.

As described above, referring to FIG. 1 to FIG. 4, the second board 1*b* can be connected to the first board 1*a*, the third board 1*c* can be connected to the second board 1*b*, and the fourth board 1*d* can be connected between the third board 1*c* and the first board 1*a*. For example, the first board 1*a*, the second board 1*b*, the third board 1*c* and the fourth board 1*d* surrounding a surrounding space 100 can be rectangular in shape, and preferably, surrounding space in the shape of a square; however, the present disclosure is not limited thereto. In addition, for example, the material of the holder 1, the first antenna assembly 2A, and the second antenna assembly 2B may be a conductive metal. Preferably, the first board 1*a*, the second board 1*b*, the third board 1*c*, and the fourth board 1*d* of the holder 1 may be integrally formed. More preferably, the holder 1 may be integrally formed with the first antenna assembly 2A and the second antenna assembly 2B. However, it should be noted that the present disclosure is not limited thereto. Further, although the antenna structure U includes the holder 1, the first antenna assembly 2A, and the second antenna assembly 2B in the first embodiment as an example, in other embodiments (for example, the second embodiment), the antenna structure U may not be provided with the second antenna assembly 2B, and the present disclosure is not limited thereto.

As described above, and further referring to FIG. 1 to FIG. 4, a first slot 101 is formed between the first board 1*a* and the second board 1*b*, a second slot 102 is formed between the second board 1*b* and the third board 1*c*, a third slot 103 is formed between the third board 1*c* and the fourth board 1*d*, and a fourth slot 104 is formed between the fourth board 1*d* and the first board 1*a*. For example, the first slot 101, the second slot 102, the third slot 103, and the fourth slot 104 may have a V shape. However, the present disclosure is not limited thereto.

Figure 5:
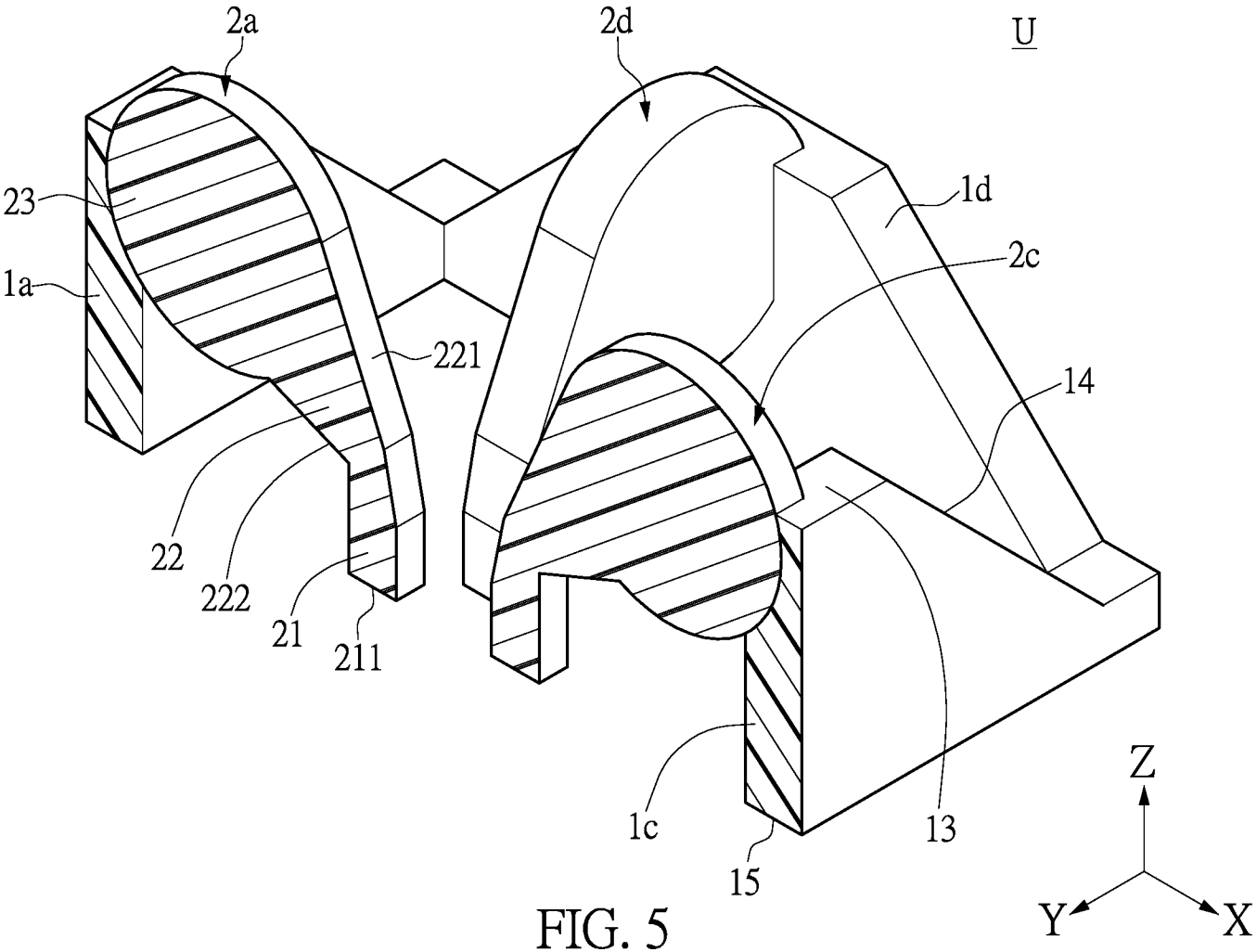
FIG. 5 is a schematic perspective cross-sectional view of the antenna structure according to the first embodiment of the present disclosure.
Figure 6:
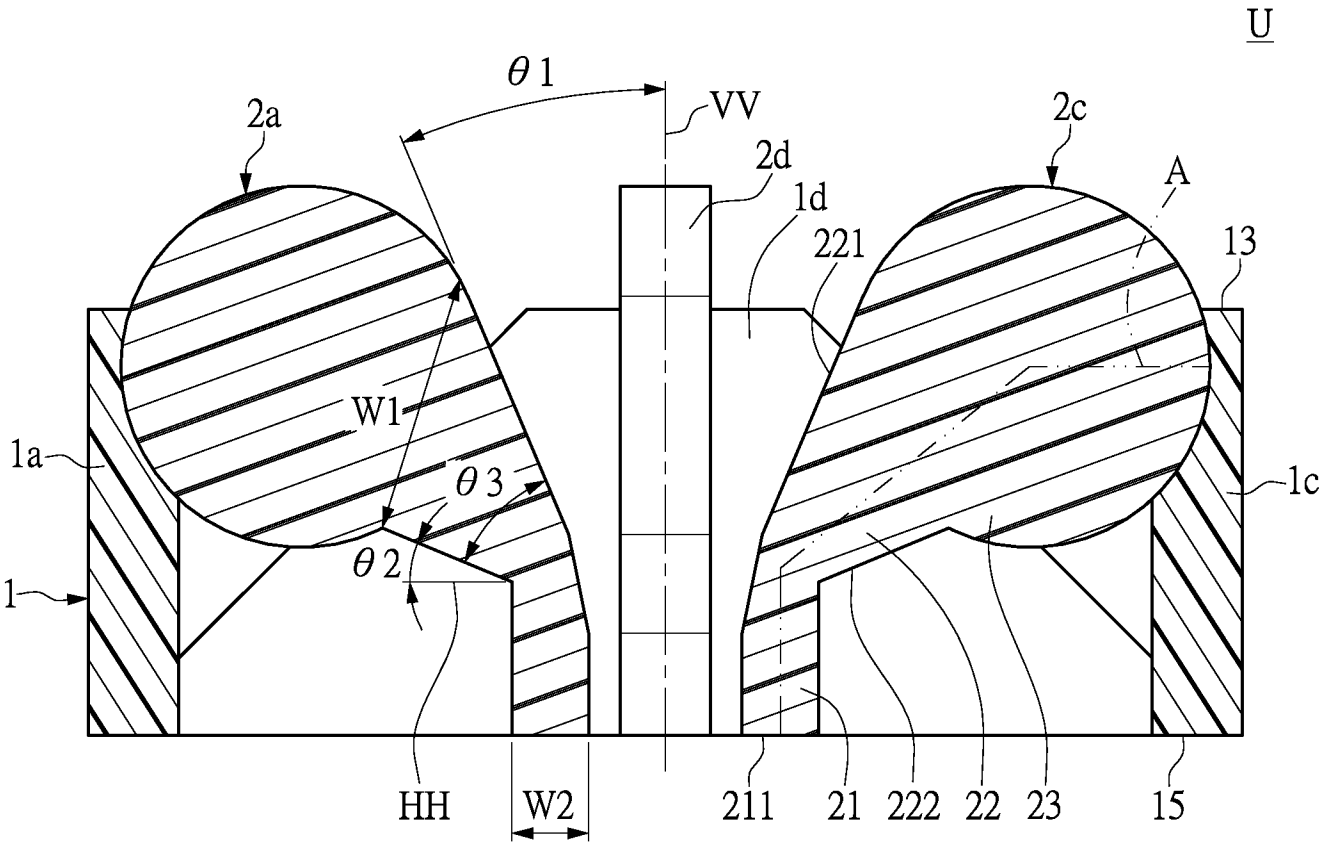
FIG. 6 is a schematic cross-sectional view taken along line VI-VI of FIG. 1.

Referring to FIG. 1 to FIG. 4, and FIG. 5 and FIG. 6, FIG. 5 is a schematic perspective cross-sectional view of the antenna structure according to the first embodiment of the present disclosure, and FIG. 6 is a schematic cross-sectional view taken along line VI-VI of FIG. 1. The first antenna body 2*a*, the second antenna body 2*b*, the third antenna body 2*c*, and the fourth antenna body 2*d* can respectively include a feeding portion 21, a conjoining portion 22 connected to the feeding portion 21, and a ground portion 23 connected to the conjoining portion 22. The feeding portion 21 of the first antenna body 2*a*, the second antenna body 2*b*, the third antenna body 2*c*, and the fourth antenna body 2*d* can be used to receive a signal fed by a radio frequency chip (or a radio frequency circuit such as a chip C in the fourth embodiment). Further, the ground portion 23 of the first antenna body 2*a* may be connected to the first board 1*a*, the ground portion 23 of the second antenna body 2*b* may be connected to the second board 1*b*, and the ground portion 23 of the third antenna body 2*c* may be connected to the third board 1*c*, and the ground portion 23 of the fourth antenna body 2*d* may be connected to the fourth board 1*d*. In addition, at least one of the first board 1*a*, the second board 1*b*, the third board 1*c*, and the fourth board 1*d* may be coupled to a ground terminal of the radio frequency chip.

As described above, referring to FIG. 1 to FIG. 4, in the present disclosure, the feeding portions 21 of the first antenna body 2*a*, the second antenna body 2*b*, the third antenna body 2*c*, and the fourth antenna body 2*d* may be adjacent to the center of the surrounding space 100, and the respective conjoining portions 22 and the respective ground portions 23 of the first antenna body 2*a*, the second antenna body 2*b*, the third antenna body 2*c*, and the fourth antenna body 2*d* extend away from the center of the surrounding space 100 toward the direction of the corresponding first board 1*a*, the corresponding second board 1*b*, the corresponding third board 1*c*, and the corresponding fourth board 1*d*, respectively. That is, the first antenna body 2*a*, the second antenna body 2*b*, the third antenna body 2*c*, and the fourth antenna body 2*d* may extend in an obliquely upward direction, respectively, but the present disclosure is not limited thereto.

As described above, referring further to FIG. 1 to FIG. 4, the polarization direction of the first antenna body 2*a* may be different from the polarization direction of the second antenna body 2*b*, and the polarization direction of the third antenna body 2*c* and the polarization direction of the fourth antenna body 2*d* are different from each other. In one embodiment, the polarization direction of the first antenna body 2*a* may be substantially orthogonal to the polarization direction of the second antenna body 2*b*, and the polarization direction of the third antenna body 2*c* is substantially orthogonal to the polarization direction of the fourth antenna body 2*d* to generate the effect of polarization diversity. Further, the polarization direction of the first antenna body 2*a* may be substantially the same as the polarization direction of the third antenna body 2*c*, and the polarization direction of the second antenna body 2*b* may be substantially the same as the polarization direction of the fourth antenna body 2*d*. In other words, in the present disclosure, the first antenna body 2*a*, the second antenna body 2*b*, the third antenna body 2*c*, and the fourth antenna body 2*d* may be arranged in the shape of a cross. Furthermore, in the present disclosure, the first antenna body 2*a* and the third antenna body 2*c* may be a horizontally polarized antenna, and the second antenna body 2*b* and the fourth antenna body 2*d* may be a vertically polarized antenna, but the present disclosure is not limited thereto. Thereby, the antenna structure U of the present disclosure can radiate respectively in two different polarization directions.

Next, referring to FIG. 1 to FIG. 4, and FIG. 7, FIG. 7 is a schematic side view of the antenna structure according to the first embodiment of the present disclosure. It should be noted that the structures and shapes of the first board 1*a*, the second board 1*b*, the third board 1*c*, and the fourth board 1*d* are substantially similar. Therefore, only one of the boards is exemplified below, and the structural features of the other boards are not described herein. In detail, the first board 1*a*, the second board 1*b*, the third board 1*c*, and the fourth board 1*d* may respectively include a main body portion 11 and two connecting portions 12 respectively disposed on both sides of the main body portion 11. The first board 1*a*, the second board 1*b*, the third board 1*c*, and the fourth board 1*d* may be connected to each other by the connecting portions 12, respectively, and the first slot 101, the second slot 102, the third slot 103, and the fourth slot 104 may be respectively formed between the connecting portions 12 that are correspondingly connected to each other. In addition, it should be noted that, in order to exemplify the positional relationship between the main body portion 11 and the connecting portion 12, the positions of the main body portion 11 and the connecting portion 12 are separated by broken lines in the figure. However, it should be noted that the position of the broken lines in the figures is merely illustrative, and the present disclosure is not limited thereto.

Referring to FIG. 1 to FIG. 7, the first board 1*a*, the second board 1*b*, the third board 1*c*, and the fourth board 1*d* may each have a predetermined height H, and the size of the predetermined height H may decrease from the main body portion 11 to the connecting portion 12. In other words, since the size of the predetermined height H can decrease from the main body portion 11 to the connecting portion 12, when the first board 1*a*, the second board 1*b*, the third board 1*c*, and the fourth board 1*d* are connected to each other, the first slot 101, the second slot 102, the third slot 103, and the fourth slot 104 can be formed.

Figure 7:
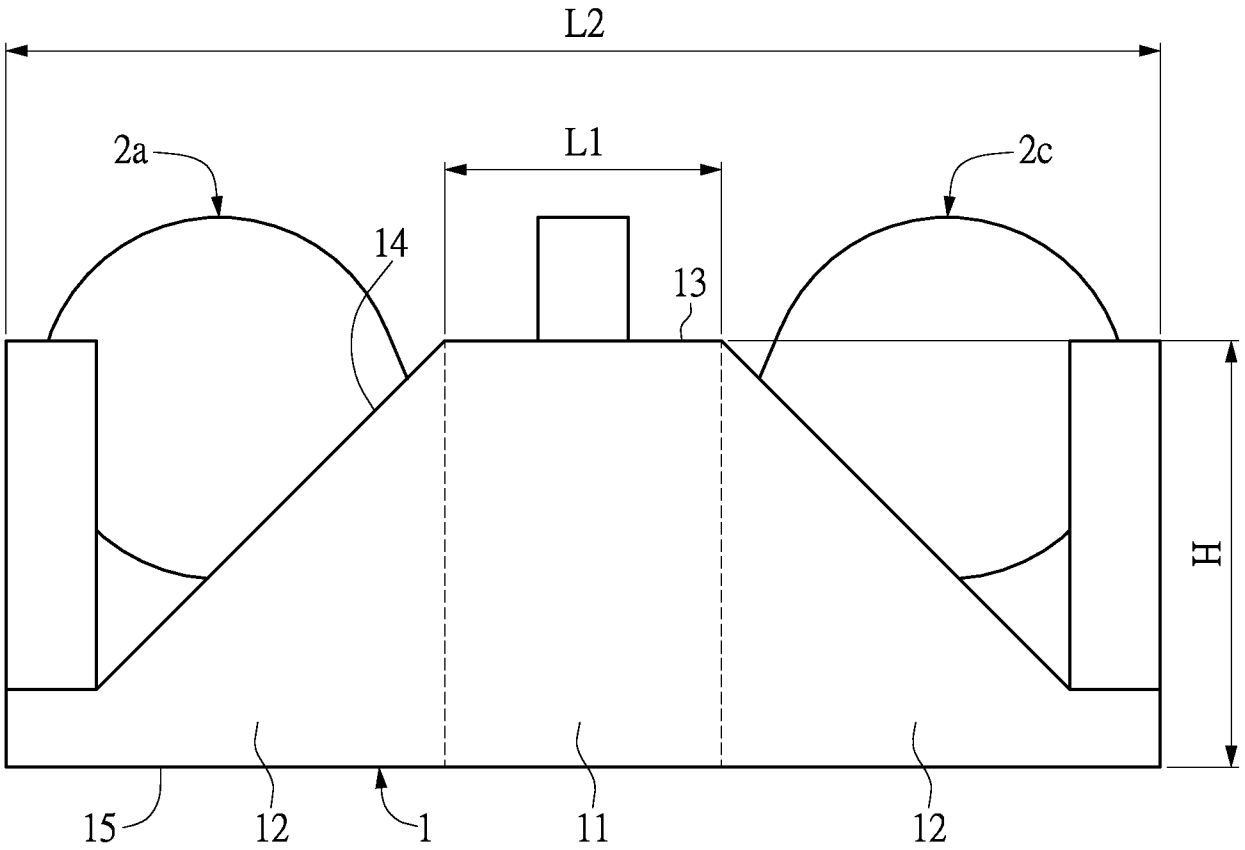
FIG. 7 is a schematic side view of the antenna structure according to the first embodiment of the present disclosure.
Figure 8:
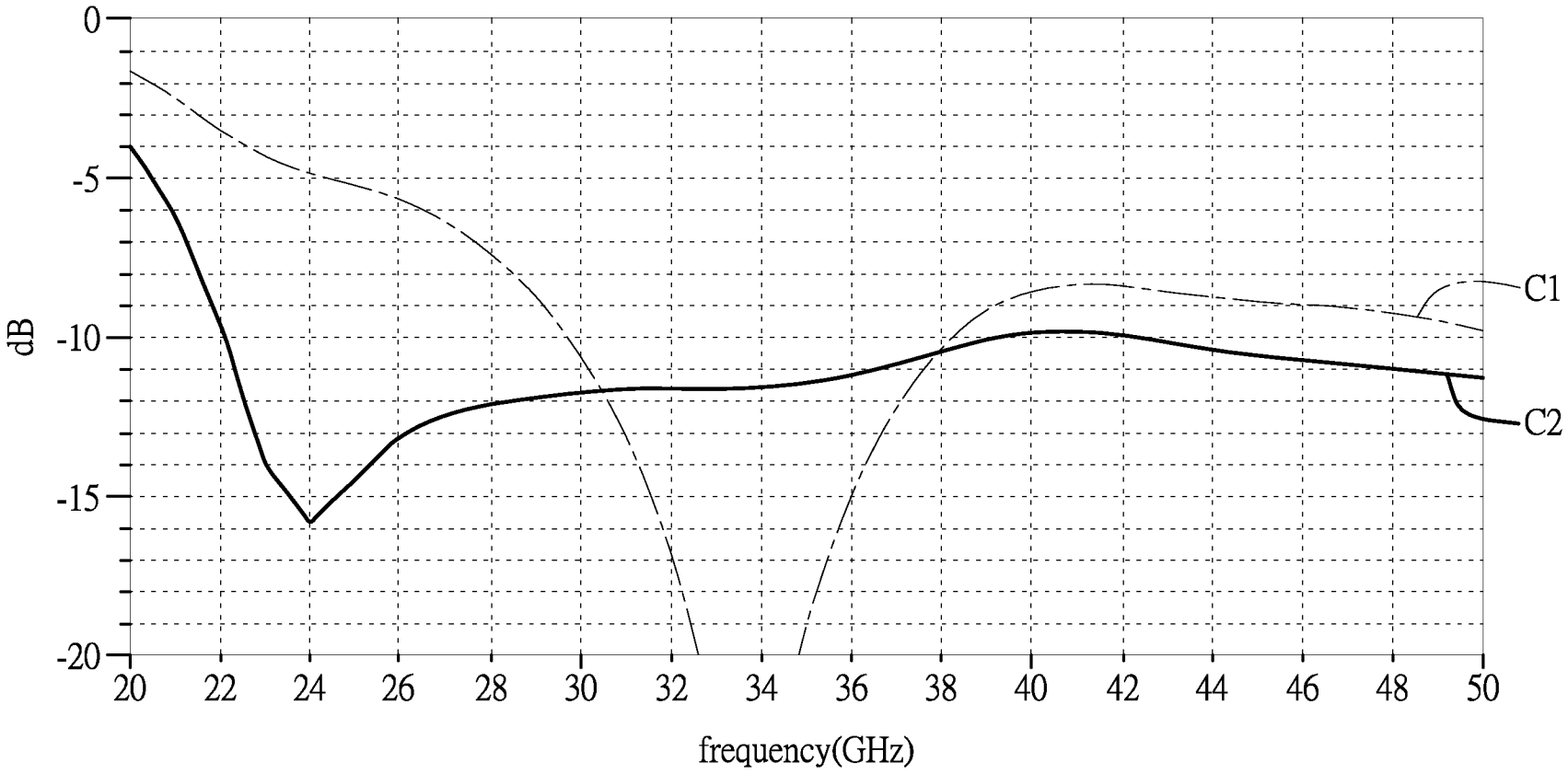
FIG. 8 is a graph showing the curve of the reflection loss of the antenna structure according to the first embodiment of the present disclosure.

As described above, referring to FIG. 1 to FIG. 7 and FIG. 8, FIG. 8 is a graph showing the curve of the reflection loss of the antenna structure according to the first embodiment of the present disclosure. Curve C1 in FIG. 8 represents an antenna structure not having the first slot 101, the second slot 102, the third slot 103, and the fourth slot 104, and curve C2 in FIG. 8 represents an antenna structure U having the first slot 101, the second slot 102, the third slot 103, and the fourth slot 104. For example, by providing the first slot 101, the second slot 102, the third slot 103, and the fourth slot 104, the cutoff frequency may fall outside of the operating band, that is, the cutoff frequency may be lower than the low frequency band (such as but not limited to a frequency between 22 GHz and 30 GHz) to improve impedance matching and reduce the impact of return loss.

As described above, referring to FIG. 1 to FIG. 7, the first board 1*a*, the second board 1*b*, the third board 1*c*, and the fourth board 1*d* may have a top surface 13 and two side surfaces 14, respectively. The top surface 13 may be located on the main body portion 11, and the two side surfaces 14 may be respectively located on the corresponding connecting portion 12. In other words, in one of the boards, the top surface 13 can be connected between the two side surfaces 14. It should also be noted that although the side surface 14 in the figures is exemplified as being a slope, in other embodiments, the side surface 14 may also be a curved surface. In addition, for example, the curved surface may be a convex curved surface or a concave curved surface. In addition, it should be noted that the present disclosure is not limited to the form of the side surface 14 mentioned above. In addition, it is worth mentioning that, as shown in FIG. 7, since the side surface 14 of the connecting portion 12 is provided as an inclined plane, the opposite sides of the first board 1*a*, the second board 1*b*, the third board 1*c*, and the fourth board 1*d* may form a triangular notch, respectively. However, the present disclosure is not limited thereto.

As described above, referring to FIGS. 1 to 7, the first board 1*a*, the second board 1*b*, the third board 1*c*, and the fourth board 1*d* may each have a bottom surface 15, and the bottom surface 15 may be disposed corresponding to the top surface 13. Further, the top surface 13 may have a first predetermined length L1, and the bottom surface 15 may have a second predetermined length L2. Further, in order to form the first slot 101, the second slot 102, the third slot 103, and the fourth slot 104, the size of the first predetermined length L1 may be smaller than the size of the second predetermined length L2.

Next, referring to FIG. 5 to FIG. 7, in the present disclosure, the first antenna body 2*a*, the second antenna body 2*b*, the third antenna body 2*c*, and an end surface 211 of the feeding portion 21 of the fourth antenna body 2*d* may have an electrical length between the corresponding first board 1*a*, the second board 1*b*, the third board 1*c*, and the bottom surface 15 of the fourth board 1*d*. The electrical length may be greater than ¼ times the wavelength of the lowest operating frequency of the antenna structure U. Thereby, in the present disclosure, the electrical length can be calculated using 22 GHz. Further, the electrical length can be calculated as the shortest distance from the end surface 211 of the feeding portion 21 of the antenna body, and sequentially along the feeding surface 21, the conjoining portion 22, the ground portion 23, and the main body portion 11 to the bottom surface 15 of the board body.

Next, referring to FIG. 5 to FIG. 7, the cross-section along the lengthwise direction of the conjoining portions 22 of the first antenna body 2*a*, the second antenna body 2*b*, the third antenna body 2*c*, and the fourth antenna body 2*d* may be in a tapered shape so that the first antenna body 2*a*, the second antenna body 2*b*, the third antenna body 2*c*, and the fourth antenna body 2*d* are in a tapered antenna-like shape. Preferably, the width of the cross-section along the lengthwise direction of the conjoining portion 22 increases from the direction of the feeding portion 21 toward the ground portion 23. In detail, the conjoining portion 22 may have a first outer surface 221 corresponding to the cross-section and a second outer surface 222 corresponding to the cross-section and relative to the first outer surface 221. For example, the first outer surface 221 may be adjacent to a vertical reference portion VV and the first outer surface 221 and the vertical reference portion VV may have a first predetermined angle θ1 between 20 degrees and 60 degrees. Preferably, the first predetermined angle θ1 may be between 30 degrees and 45 degrees. In addition, the second outer surface 222 and a horizontal reference portion HH may have a second predetermined angle θ2, and the cross-section of the conjoining portion 22 may have a third predetermined angle θ3. In the present disclosure, the sum of the first predetermined angle θ1, the second predetermined angle θ2, and the third predetermined angle θ3 may be 90 degrees, and after the first predetermined angle θ1 is defined, the second predetermined angle θ2 and the third predetermined angle θ3 may be further adjusted to adjust the radiation pattern, the impedance matching, and the reflection loss. In addition, it should be noted that, the vertical reference portion VV and the horizontal reference portion HH are perpendicular to each other, and the vertical reference plane VV may be parallel to the first and third boards 1*a* and 1*c* in the viewing angle of the schematic cross-sectional view of FIG. 6. However, in another schematic cross-sectional view, such as a schematic cross-sectional view perpendicular to the line VI-VI, the vertical reference plane VV may be parallel to the second board 1*b* and the fourth board 1*d*. In other words, the vertical reference plane VV may be parallel to the X-Z plane or parallel to the Y-Z plane, and the horizontal reference portion HH may be parallel to the X-Y plane.

As described above, referring to FIG. 5 to FIG. 7, the first antenna body 2*a*, the second antenna body 2*b*, the third antenna body 2*c*, and the fourth antenna body 2*d* may be extended along a predetermined axis A (otherwise referred to as a predetermined direction) by the feeding portion 21, the conjoining portion 22, and the ground portion 23, respectively. Further, along the predetermined axis A, the maximum width W1 of the conjoining portions of the first antenna body 2*a*, the second antenna body 2*b*, the third antenna body 2*c*, and the fourth antenna body 2*d* may be larger than the maximum width W2 of the cross-section of the feeding portions 21 of the first antenna body 2*a*, the second antenna body 2*b*, the third antenna body 2*c* and the fourth antenna body 2*d*. That is, the width of the cross-section along the lengthwise direction of the conjoining portion 22 increases from the direction of the feeding portion 21 toward the ground portion 23. In addition, it should be noted that the position of the predetermined axis A in the figure is only indicative to explain that the first antenna body 2*a*, the second antenna body 2*b*, the third antenna body 2*c*, and the fourth antenna body 2*d* may respectively extend in an obliquely upward direction, but the present disclosure is not limited thereto.

As described above, referring to FIG. 1 to FIG. 7, in the first embodiment, the height from the top end surface 211 to the ground portion 23 of the feeding portion 21 may be greater than the height from the bottom surface 15 to the top surface 13 of the board body, but the present disclosure is not limited thereto this. Further, in the first embodiment, the top end of the ground portion 23 may have an arc-shaped surface to change the current distribution of the low frequency band, and improve the radiation performance of the antenna structure U at a low frequency. However, it should be noted that the present disclosure is not limited by the shape of the ground portion 23.

Second Embodiment

Figure 9:
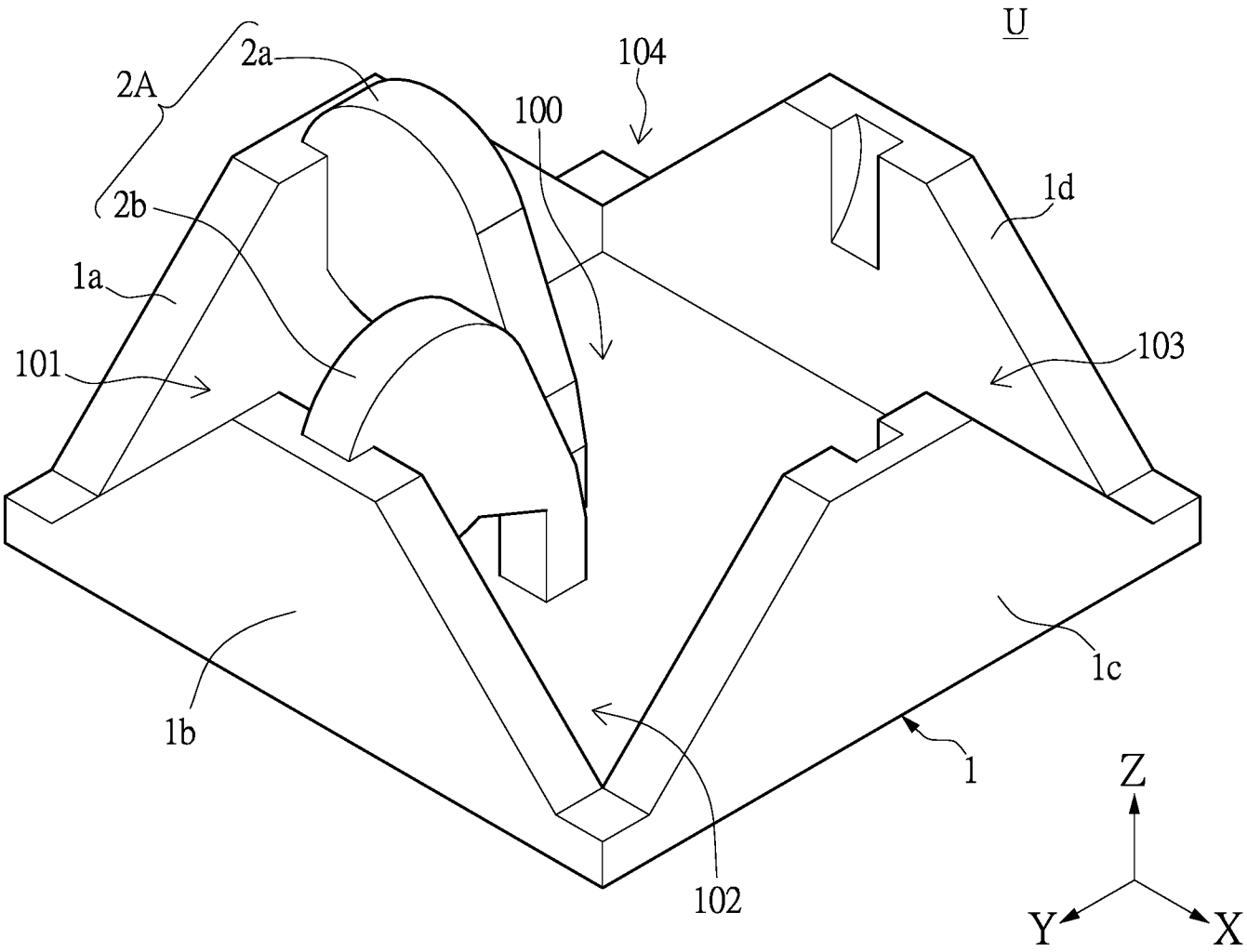
FIG. 9 is a schematic perspective assembled view of the antenna structure according to a second embodiment of the present disclosure.

Referring to FIG. 9, FIG. 9 is a schematic perspective assembled view of the antenna structure according to a second embodiment of the present disclosure. As can be observed from a comparison between FIG. 9 and FIG. 1, the greatest difference between the second embodiment and the first embodiment is that the antenna structure U provided by the second embodiment is not provided with the second antenna assembly 2B. In addition, it should be noted that, in order to achieve the effect of generating two polarization directions, the polarization direction of the first antenna body 2*a* may be substantially orthogonal to the polarization direction of the second antenna body 2*b*.

As described above, it should be noted that although the second embodiment is not provided with the second antenna assembly 2B, the structural features of the holder 1 and the first antenna assembly 2A of the antenna structure U provided by the second embodiment are still similar to those of the foregoing embodiment, and are not described herein. In other words, the holder 1 can still include a first board 1*a*, a second board 1*b*, a third board 1*c*, and a fourth board 1*d*, and the first board 1*a*, the second board 1*b*, the third board 1*c*, and the fourth board 1*d* preferably still have a first slot 101, a second slot 102, a third slot 103 and a fourth slot 104.

Third Embodiment

Figure 10:
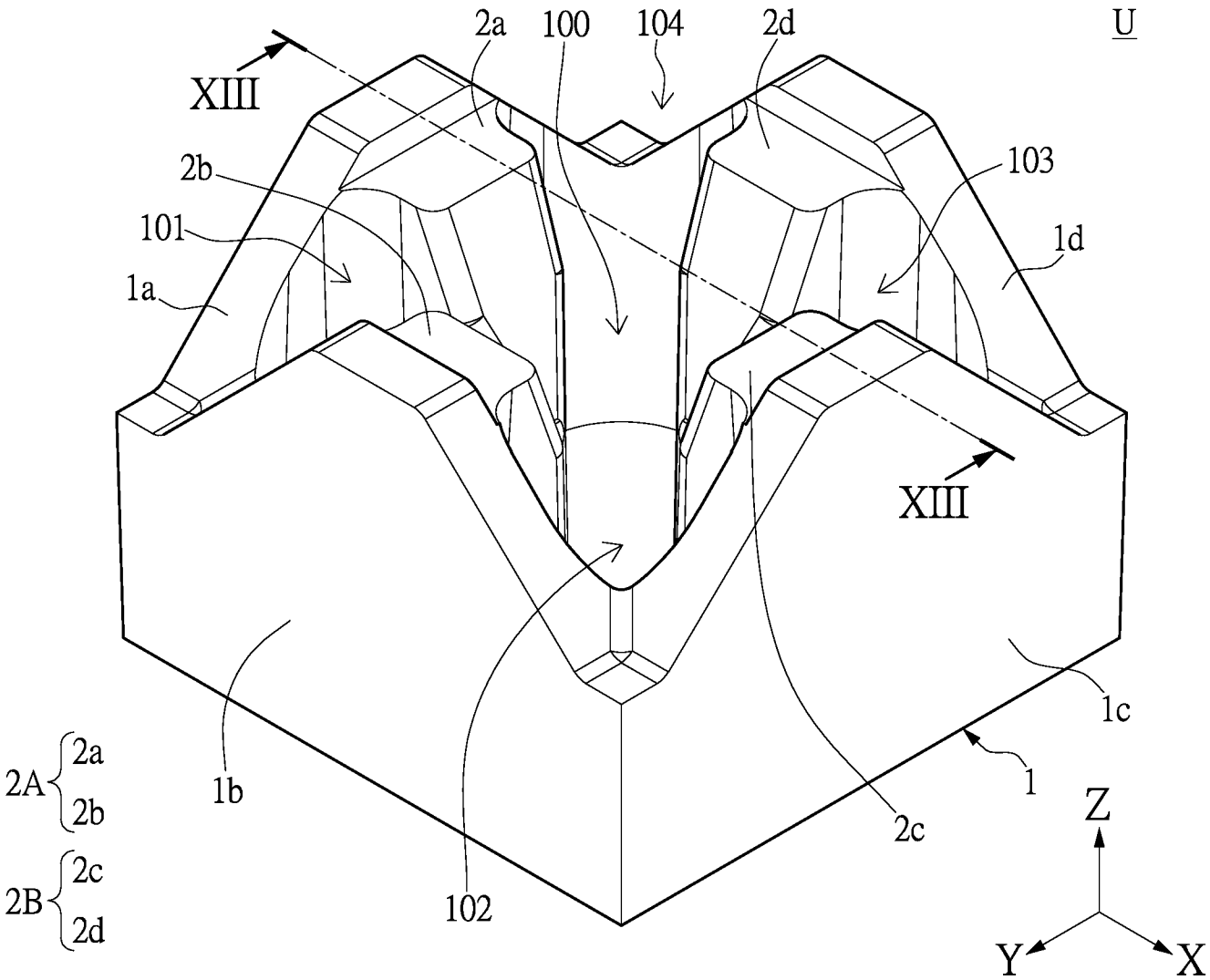
FIG. 10 is a schematic perspective view of the antenna structure according to a third embodiment of the present disclosure.
Figure 11:
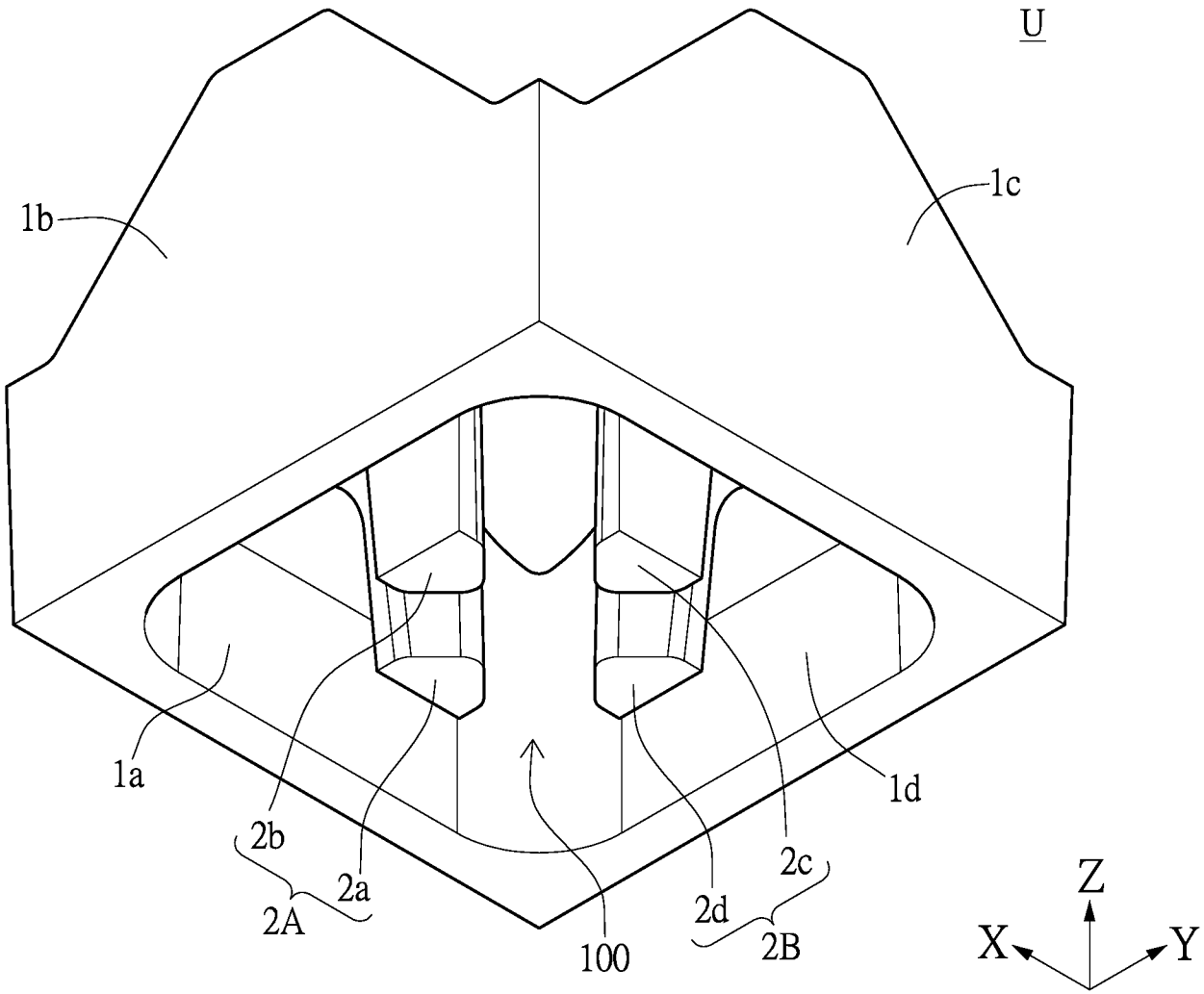
FIG. 11 is another schematic perspective view of the antenna structure according to the third embodiment of the present disclosure.
Figure 12:
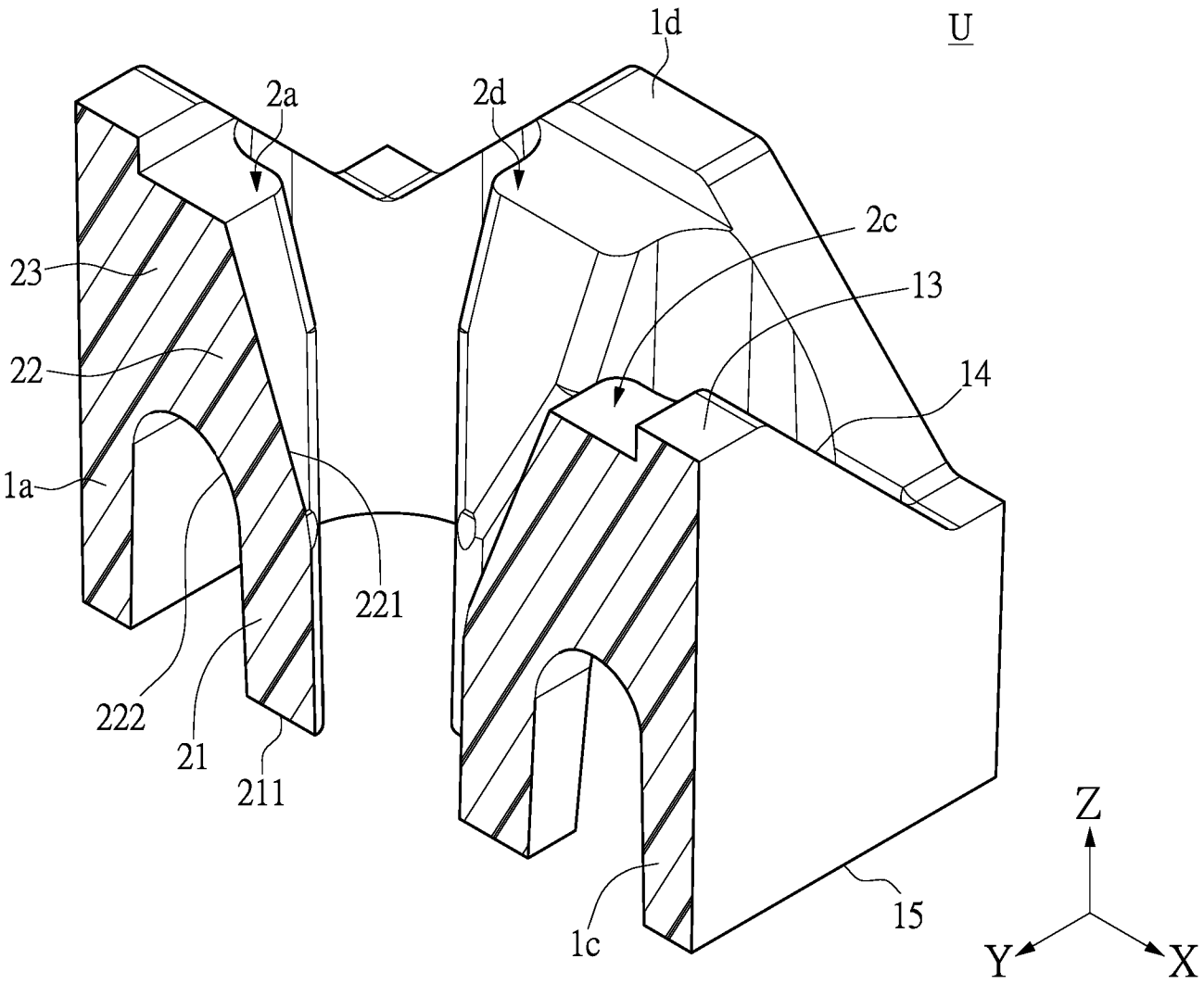
FIG. 12 is a schematic perspective cross-sectional view of the antenna structure according to the third embodiment of the present disclosure.
Figure 13:
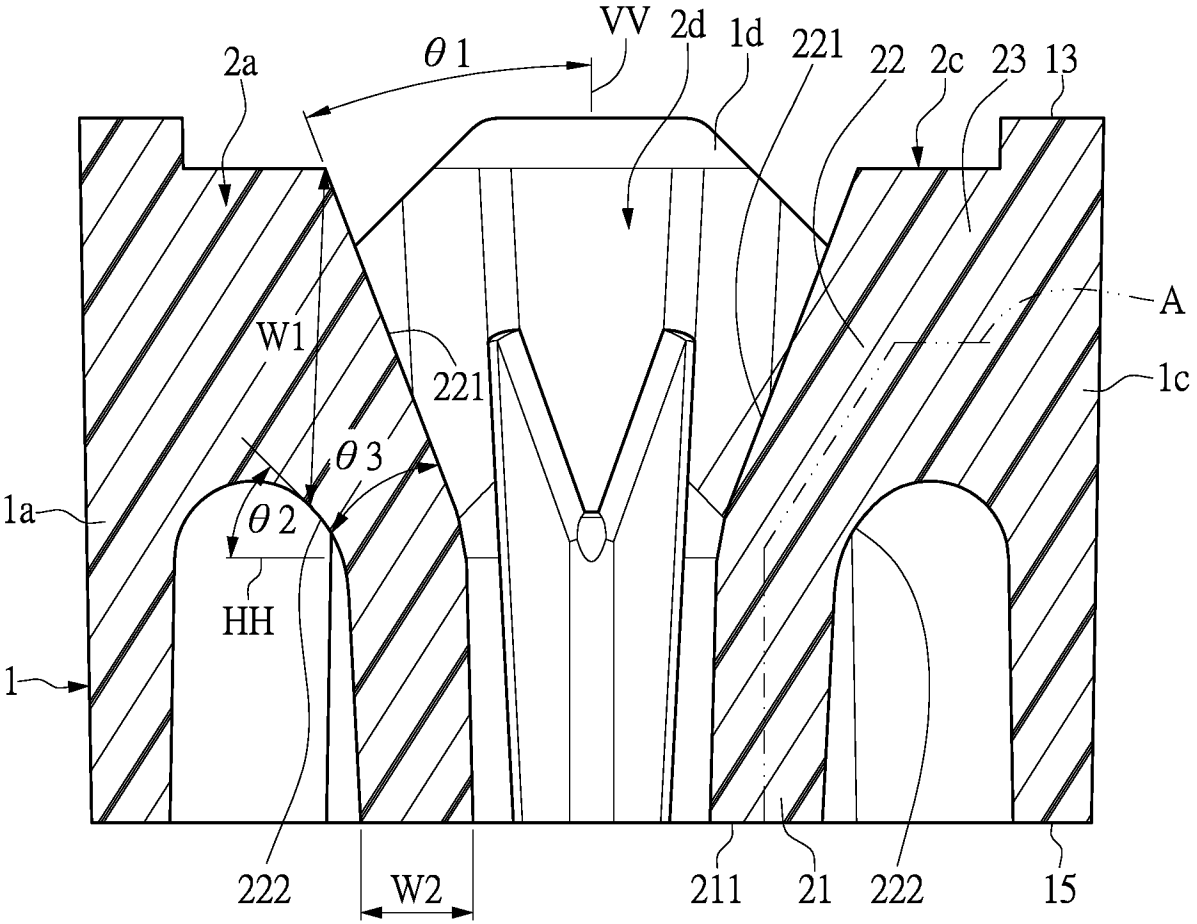
FIG. 13 is a schematic cross-sectional view taken along line XIII-XIII of FIG. 10.

Referring to FIG. 10, FIG. 13, FIG. 10 and FIG. 11 are respectively schematic perspective views of the antenna structure according to a third embodiment of the present disclosure, FIG. 12 is a schematic perspective cross-sectional view of the antenna structure according to the third embodiment of the present disclosure, and FIG. 13 is a schematic cross-sectional view taken along line XIII-XIII of FIG. 10. As can be observed from a comparison between FIG. 12 and FIG. 5, the greatest difference between the third embodiment and the foregoing embodiment is that the structural shapes of the first antenna body 2*a*, the second antenna body 2*b*, the third antenna body 2*c*, and the fourth antenna body 2*d* of the antenna structure U provided by the third embodiment are different from those of the foregoing embodiment. Further, the structural shape of the connecting portion 12 of the holder 1 of the antenna structure U provided by the third embodiment is also different from that of the foregoing embodiment. In addition, the antenna structure U provided by the third embodiment can preferably be integrally formed by a molding method, but the disclosure is not limited thereto.

As described above, referring to FIG. 10 to FIG. 13, in the third embodiment, the contact area between the ground portion 23 of the antenna structure U and the board body of the holder 1 can be increased. In addition, the thickness of the conjoining portion 22 can also be increased, so that the volume of the conjoining portion 22 is increased. Thereby, the structural strength between the first antenna assembly 2A and the second antenna assembly 2B and the holder 1 will be improved.

As described above, further referring to FIG. 10 to FIG. 13, it is worth noting that in the third embodiment, the top end of the ground portion 23 may also be a flat surface rather than an arc-shaped surface as in the foregoing embodiment. Further, the height from the top end surface 211 of the feeding portion 21 to the top end portion of the ground portion 23 may also be smaller than the height from the bottom surface 15 to the top surface 13 of the board body. In addition, in other embodiments, the surface of the top end of the ground portion 23 may also be flush with the top surface 13 of the board body. The present disclosure is not limited by the height of the top end of the ground portion 23.

As described above, further referring to FIG. 10 to FIG. 13, in the third embodiment, the contact area of the connecting portions 12 connected to each other between the adjacent two boards may be larger than the contact area of the connecting portions 12 connected to each other in the foregoing embodiment. In other words, the depth or size of the first slot 101, the second slot 102, the third slot 103, and the fourth slot 104 can be adjusted to change the bandwidth, radiation pattern, and/or isolation of the antenna structure U.

It should be noted that although the structural shape of the antenna structure U in the third embodiment is different from that of the foregoing embodiment, the structure of the holder 1, the first antenna assembly 2A, and/or the second antenna assembly 2B of the antenna structure U of the third embodiment is still similar to that of the foregoing embodiment. For example, the conditions of the predetermined height H, the first predetermined length L1, the second predetermined length L2, the first predetermined angle θ1, the second predetermined angle θ2, and the third predetermined angle θ3 of the antenna structure U in the third embodiment are also similar to those of the foregoing embodiment. Furthermore, the antenna structure U of the third embodiment can also be applied in configurations where the second antenna assembly 2B is not provided, as in the foregoing second embodiment.

Figure 14:
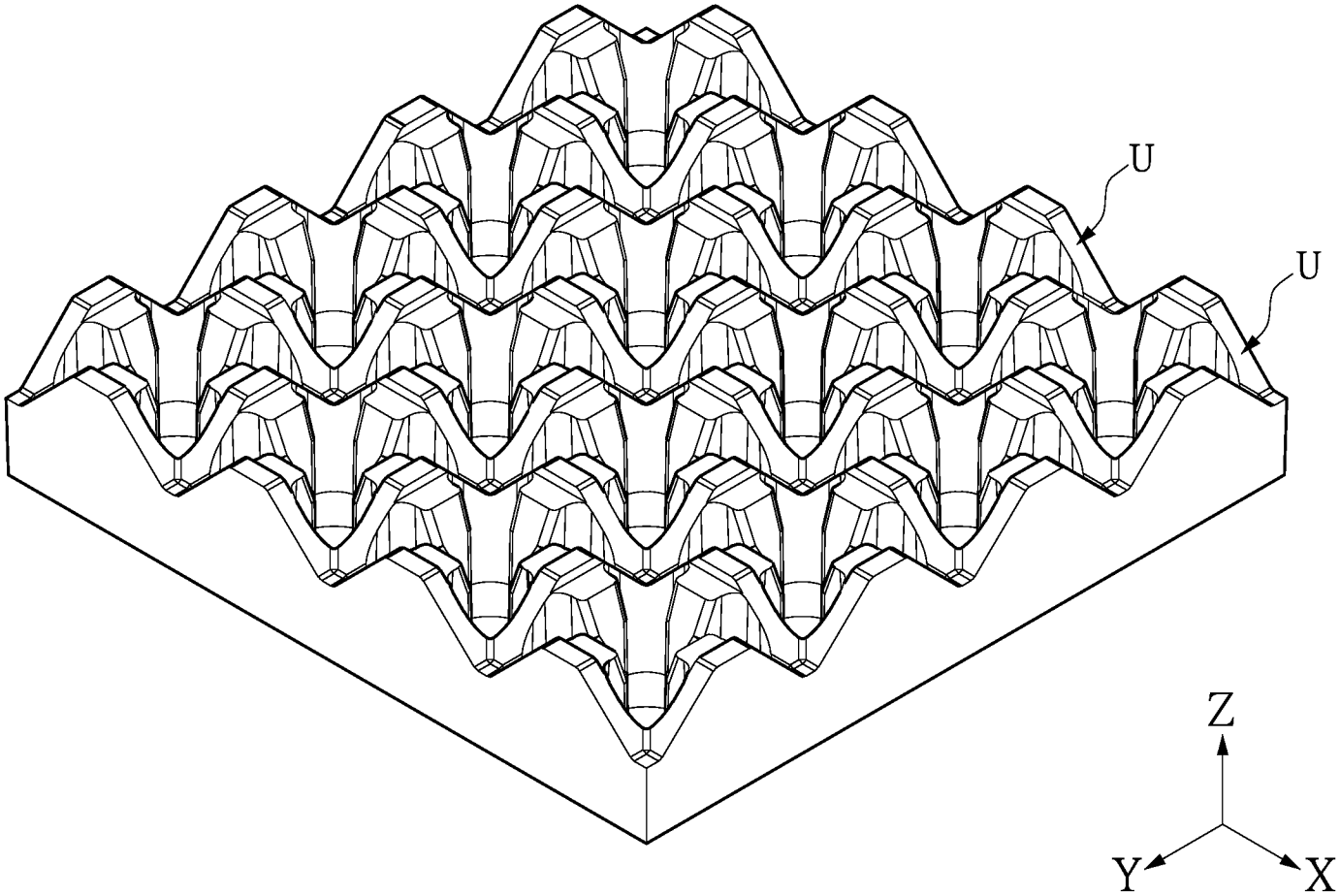
FIG. 14 is a schematic perspective view of an antenna array formed by the plurality of antenna structures according to the third embodiment of the present disclosure.

Next, referring to FIG. 14, FIG. 14 is a schematic perspective view of an antenna array formed by the plurality of antenna structures according to the third embodiment of the present disclosure. As can be seen from the comparison between FIG. 14 and FIG. 10, the antenna structures U provided by the embodiment of the present disclosure can be arranged in an array to meet the requirements of a base station. In addition, it should be noted that the thickness of the board (the first board 1*a*, the second board 1*b*, the third board 1*c*, and the fourth board 1*d*) between the two antenna structures U connected to each other in the antenna array may be further adjusted, as long as each antenna structure U meets the original design requirements.

Fourth Embodiment

Figure 15:
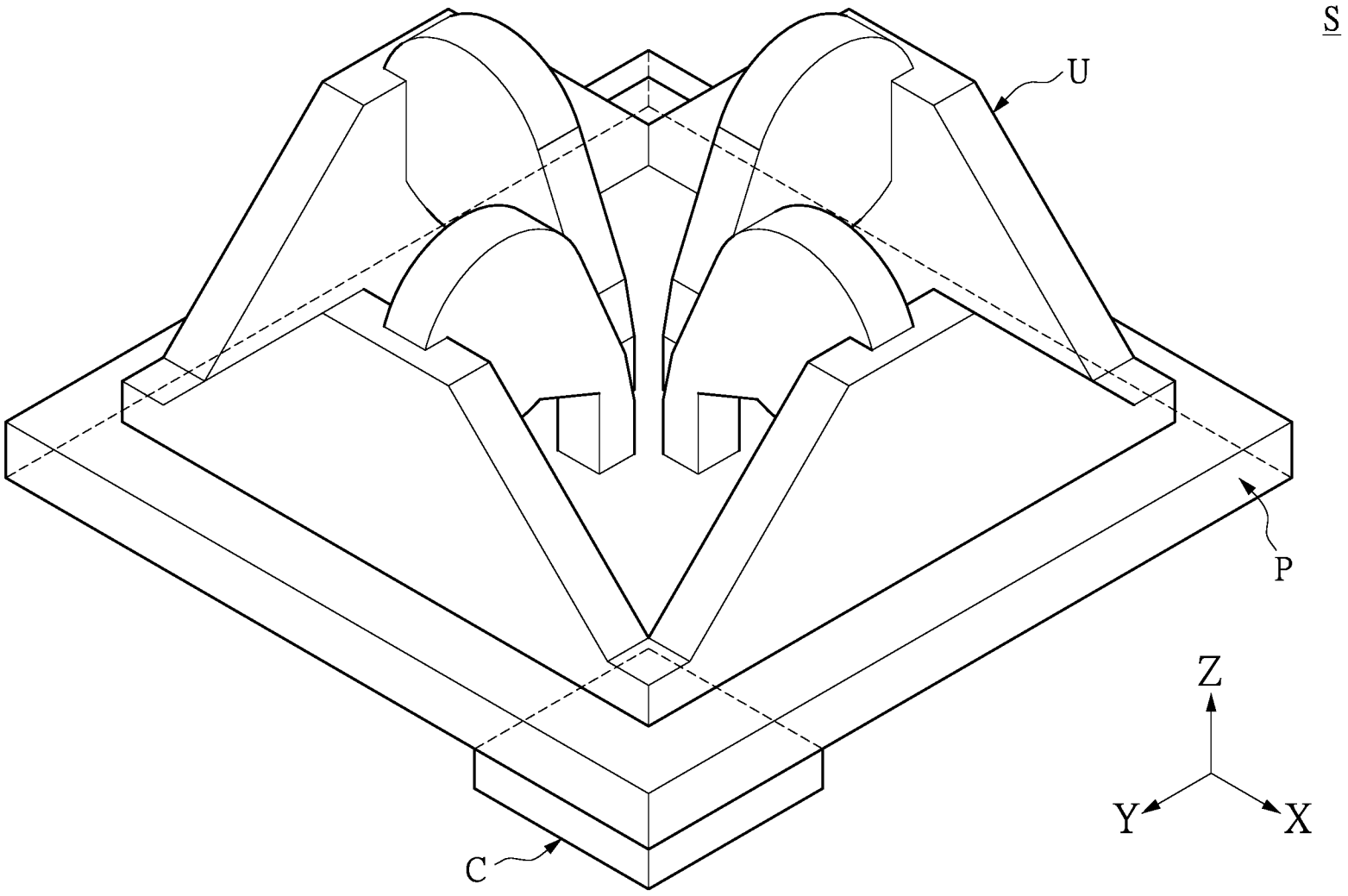
FIG. 15 is a schematic perspective view of the antenna structure according to a fourth embodiment of the present disclosure.
Figure 16:
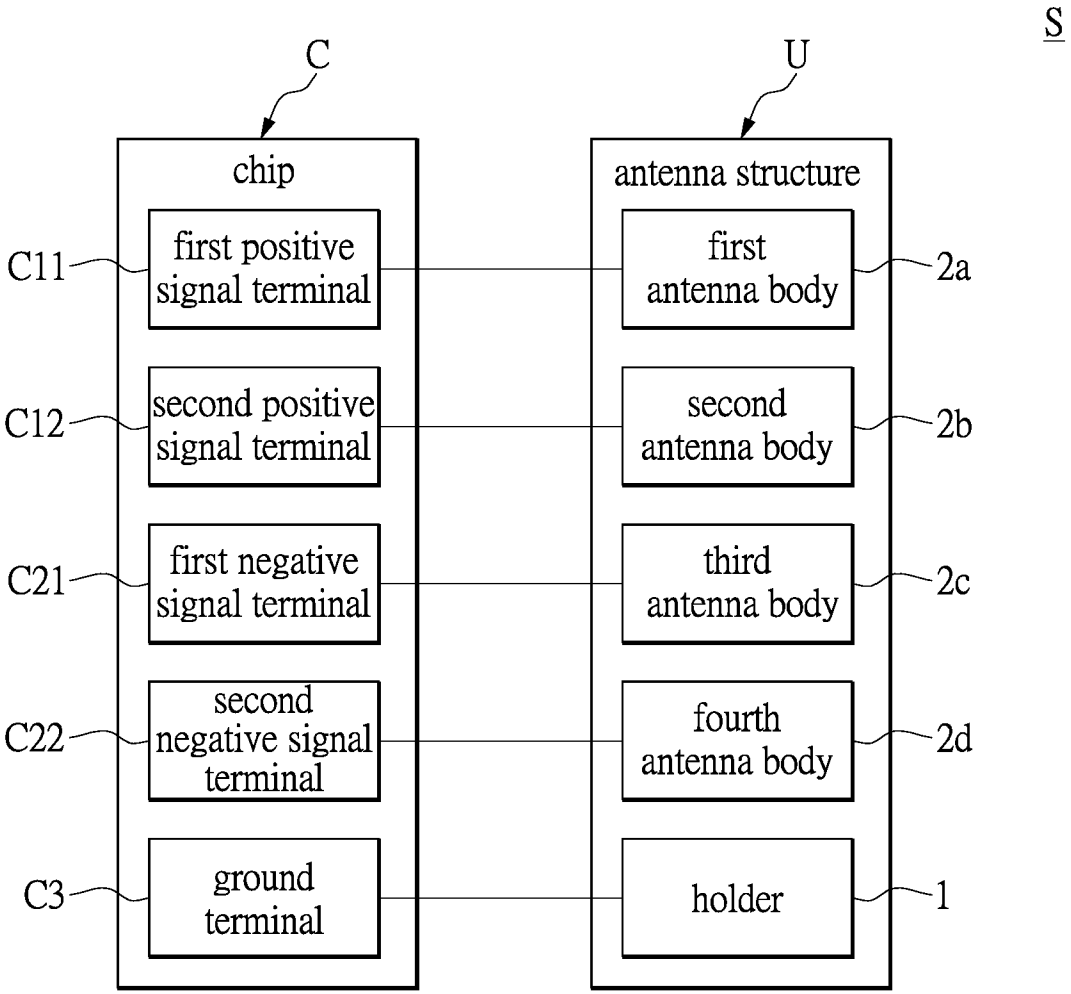
FIG. 16 is a functional block diagram of the antenna structure according to the fourth embodiment of the present disclosure.

Referring to FIG. 15 and FIG. 16, FIG. 15 is a schematic perspective view of the antenna structure according to a fourth embodiment of the present disclosure, and FIG. 16 is a functional block diagram of the antenna structure according to the fourth embodiment of the present disclosure. The fourth embodiment of the present disclosure provides an antenna system S. Although the antenna structure U is exemplified in this embodiment as the antenna structure U of the first embodiment, in other embodiments, the antenna structure U of other embodiments may be implemented. In addition, it should be noted that although the signal is exemplified as being fed by a differential pair in the figures, in other embodiments, the signal may be fed in a single feed. The following is an example of how the differential pair is used as the signal feeding method. In addition, the structural features of the holder 1, the first antenna assembly 2A, and/or the second antenna assembly 2B of the antenna structure U are similar to those of the foregoing embodiment, and will not be described herein.

As described above, further referring to FIG. 15 and FIG. 16, the antenna system S may include a chip C and an antenna structure U. In the embodiment of the figures, the antenna structure U may include a holder 1, a first antenna assembly 2A, and a second antenna assembly 2B. In addition, the antenna system S may further include a circuit board P, the chip C may be coupled to the circuit board P, and the antenna structure U may be disposed on the circuit board P. For example, the circuit board P can be a printed circuit board (PCB), but the present disclosure is not limited thereto. Thereby, the chip C and the antenna structure U can be coupled to each other through a conductive path in the circuit board P.

As described above, further referring to FIG. 15 and FIG. 16, the chip C may include a first positive signal terminal C11, a second positive signal terminal C12, a first negative signal terminal C21, a second negative signal terminal C22, and at least one ground terminal C3. The feeding portion 21 of the first antenna body 2*a* is coupled to the first positive signal terminal C11, and the feeding portion 21 of the second antenna body 2*b* is coupled to the second positive signal terminal C12. The feeding portion 21 of the third antenna body 2*c* is coupled to the first negative signal terminal C21, and the feeding portion 21 of the fourth antenna body 2*d* is coupled to the second negative signal terminal C22. In addition, the first board 1*a*, the second board 1*b*, the third board 1*c*, and the fourth board 1*d* may be coupled to the at least one ground terminal C3. It should be noted that the first board 1*a*, the second board 1*b*, the third board 1*c*, and the fourth board 1*d* are connected to each other. The first antenna body 2*a*, the second antenna body 2*b*, the third antenna body 2*c*, and the fourth antenna body 2*d* are respectively coupled to the at least one ground terminal C3 through the corresponding first board 1*a*, the corresponding second board 1*b*, the corresponding third board 1*c*, and the corresponding fourth board 1*d*. In addition, it should be noted that the coupling in the present disclosure may be a direct connection, an indirect connection, a direct electrical connection or an indirect electrical connection, and the present disclosure is not limited thereto.

It should be noted that in other embodiments, the antenna structure U in the antenna system S may also be provided without the second antenna assembly 2B as in the second embodiment. Therefore, when the antenna structure U in the second embodiment is applied to the antenna system S of the present disclosure and the chip C supports single-ended feeding, the feeding portion 21 of the first antenna body 2*a* can be coupled to the feeding portion 21 of the first positive signal terminal C11, the feeding portion 21 of the second antenna body 2*b* is coupled to the second positive signal terminal C12, and the holder 1 is coupled to the at least one ground terminal C3. In addition, if the chip supports the feeding of a differential pair, a balun can be disposed between the first antenna assembly 2A and the chip C to convert a single-ended signal into a differential signal. Thereby, even if the antenna structure U is not provided with the second antenna assembly 2B, a normal transmission and reception of signals can still be maintained. Furthermore, the present disclosure preferably feeds the signal by the differential pair. Therefore, when the antenna system S feeds the signal by the differential pair, the degree of cross polarization of the radiation pattern can be lower than that of the single feed antenna system S, and the isolation of the different polarization direction is better.

In conclusion, one of the beneficial effects of the present disclosure is that the antenna system S and the antenna structure U provided by the embodiments of the present disclosure have the technical features of "the first board 1*a*, the second board 1*b*, the third board 1*c*, and the fourth board 1*d* surrounding a surrounding space 100," "a first slot 101 being formed between the first board 1*a* and the second board 1*b*, a second slot 102 being formed between the second board 1*b* and the third board 1*c*, a third slot 103 being formed between the third board 1*c* and the fourth board 1*d*, and a fourth slot 104 being formed between the fourth board 1*d* and the first board 1*a*," "a first antenna body 2*a*, disposed in the surrounding space 100," and "a second antenna body 2*b*, disposed in the surrounding space 100," so as to improve the radiation efficiency and the heat dissipation efficiency of the antenna structure U.

Furthermore, by disposing the first antenna assembly 2A and/or the second antenna assembly 2B in the surrounding space 100 of the holder 1, the electric field generated by the first antenna assembly 2A and/or the second antenna assembly 2B can be confined to the holder 1, so that the electric field distribution at different frequencies is the same. Thereby, the variation of the antenna gain in the different frequency bands can be reduced. Further, in the present disclosure, since the first antenna assembly 2A and/or the second antenna assembly 2B are disposed in the surrounding space 100 of the holder 1, the electromagnetic field resonates between the antenna structure U and the air. Therefore, compared to the related art, the radiation efficiency of the present disclosure is better than that of a panel antenna of the related art, the electromagnetic field of which resonates between printed circuit boards. At the same time, the heat dissipation efficiency of antenna structure U of the present disclosure is better than that of the panel antenna of the related art.

Furthermore, by connecting the ground portion 23 of the first antenna assembly 2A and/or the second antenna assembly 2B to the holder 1, the molding method can also be used to integrally form the holder 1 with the first antenna assembly 2A and/or the second antenna assembly 2B as one piece. Thereby, not only can the cost be reduced and mass production be achieved, but also the structural strength of the antenna structure U can be increased.

Furthermore, the antenna structure U can be disposed on a circuit board P coupled to the chip C, whereby the thermal energy of the circuit board P and the chip C can be easily dissipated into the environment by the antenna structure U, thereby improving the heat dissipation efficiency of the antenna system S.

Furthermore, by disposing the first slot 101, the second slot 102, the third slot 103, and the fourth slot 104 on the holder 1, the cutoff frequency can be outside of the operating band, that is, the cutoff frequency can be lower than the lower band (for example, but not limited to frequencies between 22 GHz and 30 GHz) to increase impedance matching and reduce the effects of reflection loss.

Furthermore, the antenna structure U provided by the embodiment of the present disclosure can not only cover more than 60% of the 5G bandwidth, but also will not experience great changes in the gain with the change of the frequency.

The foregoing description of the exemplary embodiments of the disclosure has been presented only for the purposes of illustration and description and is not intended to be exhaustive or to limit the disclosure to the precise forms disclosed. Many modifications and variations are possible in light of the above teaching.

The embodiments were chosen and described in order to explain the principles of the disclosure and their practical application so as to enable others skilled in the art to utilize the disclosure and various embodiments and with various modifications as are suited to the particular use contemplated. Alternative embodiments will become apparent to those skilled in the art to which the present disclosure pertains without departing from its spirit and scope.

What is claimed is:

1. An antenna system, comprising:

a chip including a first positive signal terminal, a second positive signal terminal, and at least one ground terminal; and an antenna structure including a holder and a first antenna assembly;

wherein the holder includes:

a first board;

a second board connected to the first board;

a third board connected to the second board; and a fourth board connected between the first board and the third board;

wherein the first board, the second board, the third board, and the fourth board surround a surrounding space; a first slot is formed between the first board and the second board, a second slot is formed between the second board and the third board, a third slot is formed between the third board and the fourth board, and a fourth slot is formed between the fourth board and the first board;

wherein the first antenna assembly includes:

a first antenna body disposed in the surrounding space; and a second antenna body disposed in the surrounding space;

wherein the first antenna body and the second antenna body respectively include a feeding portion, a conjoining portion connected to the feeding portion, and a ground portion connected to the conjoining portion; the ground portion of the first antenna body is connected to the first board, and the ground portion of the second antenna body is connected to the second board;

wherein the feeding portion of the first antenna body is coupled to the first positive signal terminal, and the feeding portion of the second antenna body is coupled to the second positive signal terminal;

wherein the first board is coupled to the ground terminal, and the second board is coupled to the ground terminal.

2. The antenna system according to claim 1, wherein the antenna structure further comprises a second antenna assembly including a third antenna body and a fourth antenna body, and the third antenna body and the fourth antenna body are disposed in the surrounding space; wherein the third antenna body and the fourth antenna body respectively include a feeding portion, a conjoining portion connected to the feeding portion, and a ground portion connected to the conjoining portion; wherein the ground portion of the third antenna body is connected to the third board, and the ground portion of the fourth antenna body is connected to the fourth board, wherein the chip further includes a first negative signal terminal and a second negative signal terminal; the feeding portion of the third antenna body is coupled to the first negative signal terminal, and the feeding portion of the fourth antenna body is coupled to the second negative signal terminal.

3. An antenna structure, comprising:

a holder including:

a first board;

a second board connected to the first board;

a third board connected to the second board; and a fourth board connected between the first board and the third board;

wherein the first board, the second board, the third board, and the fourth board surround a surrounding space; wherein a first slot is formed between the first board and the second board, a second slot is formed between the second board and the third board, a third slot is formed between the third board and the fourth board, and a fourth slot is formed between the fourth board and the first board;

a first antenna assembly includes a first antenna body disposed in the surrounding space and a second antenna body disposed in the surrounding space; and a second antenna assembly includes a third antenna body disposed in the surrounding space and a fourth antenna body disposed in the surrounding space;

wherein the first antenna body, the second antenna body, the third antenna body, and the fourth antenna body respectively have a feeding portion, a conjoining portion connected to the feeding portion, and a ground portion connected to the conjoining portion;

wherein the ground portion of the first antenna body is connected to the first board, the ground portion of the second antenna body is connected to the second board, the ground portion of the third antenna body is connected to the third board, and the ground portion of the fourth antenna body is connected to the fourth board.

4. The antenna structure according to claim 3, wherein the surrounding space surrounded by the first board, the second board, the third board, and the fourth board has a rectangular shape.

5. The antenna structure according to claim 3, wherein the first board, the second board, the third board, and the fourth board respectively include a main body portion and two connecting portions respectively disposed on both sides of the main body portion; the first board, the second board, the third board, and the fourth board are connected to each other through the connecting portions, respectively, and the first slot, the second slot, the third slot, and the fourth slot are respectively formed between the connecting portions that are correspondingly connected to each other;

wherein the first board, the second board, the third board, and the fourth board respectively have a predetermined height, and the predetermined height decreases from the main body portion to the connecting portions.

6. The antenna structure according to claim 5, wherein the first board, the second board, the third board, and the fourth board respectively have a top surface and two side surfaces, the top surface is located on the main body portion, and the two side surfaces are respectively located on the connecting portion, and the top surface is connected between the two side surfaces; wherein the side surfaces are inclined planes or curved surfaces.

7. The antenna structure according to claim 3, wherein the feeding portions of the first antenna body, the second antenna body, the third antenna body and the fourth antenna body respectively have an end surface, and the corresponding first board, the corresponding second board, the corresponding third board, and the corresponding fourth board respectively have a bottom surface, and wherein each of the end surfaces and the corresponding one of the bottom surfaces has an electrical length therebetween, and the electrical length is greater than ¼ times the wavelength of the lowest operating frequency of the antenna structure.

8. The antenna structure according to claim 3, wherein the polarization direction of the first antenna body is substantially orthogonal to the polarization direction of the second antenna body, and the polarization direction of the third antenna body is substantially orthogonal to the polarization direction of the fourth antenna body.

9. The antenna structure according to claim 3, wherein the cross-section along the lengthwise direction of the conjoining portion of each of the first antenna body, the second antenna body, the third antenna body, and the fourth antenna body is in a tapered shape, and the conjoining portion has a first outer surface adjacent to a vertical reference plane; wherein the first outer surface and a vertical reference portion have a first predetermined angle between 20 degrees and 60 degrees.

10. The antenna structure according to claim 3, wherein the first antenna body, the second antenna body, the third antenna body, and the fourth antenna body respectively extend along a predetermined axis by the feeding portion, the conjoining portion, and the ground portion; along the predetermined axis, the maximum width of the cross-section of the conjoining portions of the first antenna body, the second antenna body, the third antenna body and the fourth antenna body is greater than the maximum width of the cross-section of the feeding portions of the first antenna body, the second antenna body, the third antenna body and the fourth antenna body.

11. The antenna structure according to claim 3, wherein the holder, the first antenna assembly, and the second antenna assembly are made of a conductive metal, and the holder, the first antenna assembly, and the second antenna assembly are integrally formed; wherein the first slot, the second slot, the third slot, and the fourth slot are V-shaped.

12. An antenna structure, comprising:

a holder including:

a first board;

a second board connected to the first board;

a third board connected to the second board; and a fourth board connected between the first board and the third board;

wherein the first board, the second board, the third board, and the fourth board surround a surrounding space; a first slot is formed between the first board and the second board, a second slot is formed between the second board and the third board, a third slot is formed between the third board and the fourth board, and a fourth slot is formed between the fourth board and the first board; and a first antenna assembly including:

a first antenna body disposed in the surrounding space; and a second antenna body disposed in the surrounding space;

wherein the first antenna body and the second antenna body respectively include a feeding portion, a conjoining portion connected to the feeding portion, and a ground portion connected to the conjoining portion;

wherein the ground portion of the first antenna body is connected to the first board, and the ground portion of the second antenna body is connected to the second board.

13. The antenna structure according to claim 12, wherein the antenna structure further comprises a second antenna assembly including a third antenna body and a fourth antenna body, and the third antenna body and the fourth antenna body are disposed in the surrounding space; wherein the third antenna body and the fourth antenna body respectively include a feeding portion, a conjoining portion connected to the feeding portion, and a ground portion connected to the conjoining portion; wherein the ground portion of the third antenna body is connected to the third board, and the ground portion of the fourth antenna body is connected to the fourth board.

14. The antenna structure according to claim 12, wherein the feeding portions of the first antenna body and the second antenna body respectively have an end surface, and the corresponding first board and the corresponding second board respectively have a bottom surface, and wherein each of the end surfaces and the corresponding one of the bottom surfaces has an electrical length therebetween, and the electrical length is greater than ¼ times the wavelength of the lowest operating frequency of the antenna structure.

15. The antenna structure according to claim 12, wherein the cross-sections along the lengthwise direction of the conjoining portion of each of the first antenna body and the second antenna body is in a tapered shape, and the conjoining portion has a first outer surface adjacent to a vertical reference plane; wherein the first outer surface and the vertical reference plane have a first predetermined angle between 20 degrees and 60 degrees.

* * * * *